US012121066B2

(12) United States Patent
Lee et al.

(10) Patent No.: US 12,121,066 B2
(45) Date of Patent: Oct. 22, 2024

(54) HEATER ASSEMBLY AND AEROSOL GENERATING SYSTEM

(71) Applicant: KT&G CORPORATION, Daejeon (KR)

(72) Inventors: Wonkyeong Lee, Gyeonggi-do (KR); Heon Jun Jeong, Seoul (KR); Dong Sung Kim, Seoul (KR); Jae Sung Choi, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 367 days.

(21) Appl. No.: 17/626,752

(22) PCT Filed: Jun. 24, 2021

(86) PCT No.: PCT/KR2021/007956
§ 371 (c)(1),
(2) Date: Jan. 12, 2022

(87) PCT Pub. No.: WO2022/005104
PCT Pub. Date: Jan. 6, 2022

(65) Prior Publication Data

US 2022/0248760 A1 Aug. 11, 2022

(30) Foreign Application Priority Data

Jul. 3, 2020 (KR) ..... 10-2020-0082266

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/51* (2020.01); *A24F 40/57* (2020.01)

(58) Field of Classification Search
CPC ..... A24F 40/46; A24F 40/20; A24F 40/57; A24F 40/40; A24F 40/50; H05B 6/108;
(Continued)

(56) References Cited

U.S. PATENT DOCUMENTS 9,516,899 B2 12/2016 Plojoux et al.
10,117,459 B2 11/2018 Lavanchy et al.
(Continued)

FOREIGN PATENT DOCUMENTS

CN 107148224 A 9/2017
CN 111050579 A 4/2020
(Continued)

OTHER PUBLICATIONS

Office Action dated Jan. 17, 2023 from the Japanese Patent Office in JP Application No. 2022-505650.
(Continued)

*Primary Examiner* — Jean F Duverne
(74) *Attorney, Agent, or Firm* — Sughrue Mion, PLLC

(57) ABSTRACT

A heater assembly for an aerosol generating device includes a heating portion that heats an aerosol generating article by using electrical power applied thereto, and an expansion portion that is separated from the heating portion, and receives heat from the heating portion and heats the aerosol generating article.

15 Claims, 7 Drawing Sheets

(51) Int. Cl.
*A24F 40/51* (2020.01)
*A24F 40/57* (2020.01)

(58) Field of Classification Search
CPC ... H05B 1/02; H05B 3/20; H05B 3/40; H05B 6/10; H05B 2203/002; H05B 2203/021
See application file for complete search history.

(56) References Cited

U.S. PATENT DOCUMENTS

| | | | | |
|---|---|---|---|---|
| 10,842,190 | B2 | 11/2020 | Lavanchy et al. | |
| 10,874,146 | B2 | 12/2020 | Chau et al. | |
| 11,141,548 | B2 | 10/2021 | Gomez et al. | |
| 2011/0147486 | A1 | 6/2011 | Greim et al. | |
| 2018/0007959 | A1 | 1/2018 | Lavanchy et al. | |
| 2018/0168226 | A1 | 6/2018 | Mironov et al. | |
| 2019/0208820 | A1 | 7/2019 | Reevell | |
| 2020/0093177 | A1 | 3/2020 | Han et al. | |
| 2020/0237005 | A1 * | 7/2020 | Lim | A24F 40/57 |
| 2020/0253280 | A1 | 8/2020 | Thorsen | |
| 2020/0281273 | A1 | 9/2020 | Kim et al. | |
| 2020/0359695 | A1 | 11/2020 | Lim | |
| 2021/0000185 | A1 | 1/2021 | Jung et al. | |

FOREIGN PATENT DOCUMENTS

| | | | | |
|---|---|---|---|---|
| EP | 3 818 890 | A1 | 5/2021 | |
| EP | 3884789 | A1 * | 9/2021 | A24F 40/10 |
| JP | 57-186999 | U | 11/1982 | |
| JP | 62-74776 | U | 5/1987 | |
| JP | 2019-46632 | A | 3/2019 | |
| JP | 2019-518430 | A | 7/2019 | |
| JP | 2020-018285 | A | 2/2020 | |
| KR | 10-2014-0116055 | A | 10/2014 | |
| KR | 10-1892886 | B1 | 8/2018 | |
| KR | 10-2019-0021439 | A | 3/2019 | |
| KR | 10-1983367 | B1 | 5/2019 | |
| KR | 10-2029225 | B1 | 10/2019 | |
| KR | 10-2057216 | B1 | 12/2019 | |
| WO | 2020/101198 | A1 | 5/2020 | |
| WO | 2020/122408 | A1 | 6/2020 | |
| WO | WO-2021075805 | A1 * | 4/2021 | A24F 40/10 |
| WO | WO-2021122418 | A1 * | 6/2021 | A24F 40/50 |

OTHER PUBLICATIONS

International Search Report for PCT/KR2021/007956 dated Oct. 5, 2021 [PCT/ISA/210].
Written Opinion for PCT/KR2021/007956 dated Oct. 5, 2021 [PCT/ISA/237].
Communication dated Mar. 10, 2022 from the Korean Patent Office in Korean Application No. 10-2020-0082266.
Communication dated Sep. 26, 2022 from the Korean Patent Office in Korean Application No. 10-2020-0082266.
Extended European Search Report dated Jul. 15, 2022 in European Application No. 21833804.4.
Chinese Office Action dated Apr. 20, 2023 in Chinese Application No. 202180005701.2.

* cited by examiner

HEATER ASSEMBLY AND AEROSOL GENERATING SYSTEM

TECHNICAL FIELD

Embodiments relate to a heater assembly and an aerosol generation system, and more particularly, to a heater assembly and an aerosol generation system that may reduce operating costs for a heater.

BACKGROUND ART

Recently, the demand for alternative methods to overcome the shortcomings of general cigarettes has increased. For example, there is growing demand for an aerosol generating device that generates aerosols by heating an aerosol generating material in cigarettes, instead of combusting cigarettes.

Accordingly, studies on a heating-type cigarette and a heating-type aerosol generating device have been actively conducted.

An aerosol generating device includes a heater for heating a cigarette. The aerosol generating device generates an aerosol as the heater heats the cigarette inserted into the aerosol generating device, and a user may inhale the aerosol through the cigarette.

DISCLOSURE

Technical Problem

In general, a heater included in an aerosol generating device covers a portion of the cigarette that corresponds to the size of the heater. That is, in order to expand the heating area of the cigarette, the heater size needs to be expanded accordingly, which increases manufacturing/operating costs of a heater.

Technical Solution

Embodiments may provide a heater assembly and an aerosol generation system.

A heater assembly according to one embodiment includes a heating portion that heats an aerosol generating article by using electrical power applied thereto, and an expansion portion that is separated from the heating portion and heats the aerosol generating article by receiving heat from the heating portion.

An aerosol generating system according to one embodiment includes an aerosol generating article including an aerosol generating material that generates an aerosol when heated; a battery; a heating portion for heating the aerosol generating article by using power supplied by the battery; and an expansion portion that is separated from the heating portion and heats the aerosol generating article by receiving heat from the heating portion.

Advantageous Effects

A heater assembly and an aerosol generating system according to embodiments may expand a heating region of a cigarette without additional heater or electric power. Thus, energy efficiency may be improved and operating costs for a heater may be reduced.

BEST MODE

Figure 1:
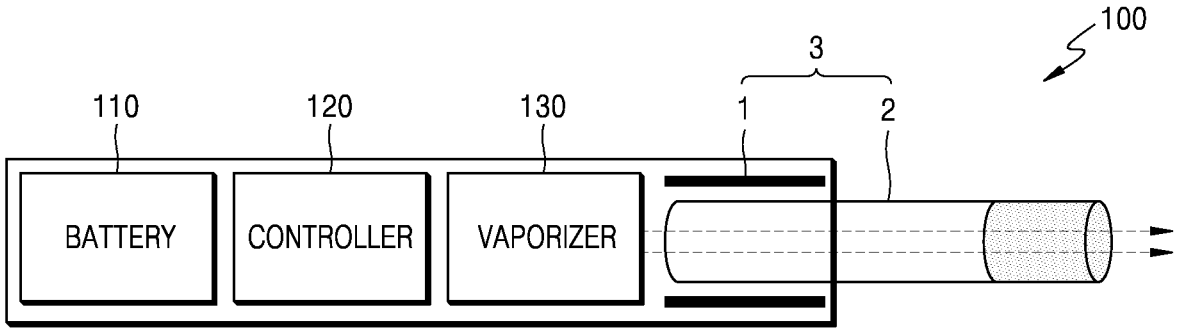
FIGS. 1 and 2 are views illustrating examples of an aerosol generating device including a heater assembly and an aerosol generating system.

Aerosol generating system according to an embodiment includes an aerosol generating article including an aerosol generating material that generates an aerosol when heated; a battery; a heating portion for heating the aerosol generating article by using power supplied by the battery; and an expansion portion that is separated from the heating portion and receives heat from the heating portion and heats the aerosol generating article.

In addition, the heating portion may heat the aerosol generating article to a first temperature, and the expansion portion may heat the aerosol generating article to a second temperature lower than the first temperature.

A heater assembly according to one embodiment includes a heating portion that heats an aerosol generating article by using electrical power applied thereto, and an expansion portion that is separated from the heating portion and receives heat from the heating portion and heats the aerosol generating article.

In addition, the expansion portion may receive the heat from the heating portion by at least one of conduction, convection, and radiation.

In addition, the expansion portion and the heating portion may have the same length in a circumferential direction of the aerosol generating article.

In addition, the expansion portion may have a shape symmetrical with respect to an axis extending in a lengthwise direction of the aerosol generating article.

In addition, the expansion portion may include a plurality of expansion patterns that receive the heat from the heating portion, and a first expansion pattern has a larger area than a second expansion pattern that is closer to the heating portion than the first expansion pattern.

In addition, the expansion portion may include three or more expansion patterns that receive the heat from the heating portion, wherein the expansion patterns are arranged such that an interval between two expansion patterns becomes smaller as a distance between the interval from the heating portion increases.

In addition, the expansion portion may be separated from the heating portion in a lengthwise direction of the aerosol generating article.

In addition, the expansion portion and the heating portion may be separated from each other in a circumferential direction of the aerosol generating article.

In addition, the heater assembly may further include a first support member that supports the heating portion, and a second support member that supports the expansion portion. The second support member may be movable with respect to the first support member to adjust a separation distance between the expansion portion and the heating portion.

In addition, one of the first support member and the second support member may be insertable into the other.

In addition, the heater assembly may further include a movement controller that controls movement of the second support member.

In addition, the heater assembly may further include a temperature sensor that detects a temperature of at least one of the expansion portion and the heating portion. The movement controller may control the movement of the second support member based on the detected temperature.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

The term "cigarette" (i.e., when used alone without a modifier such as "general," "traditional," or "combustive") may refer to any article which has a shape similar to a traditional combustive cigarette. This cigarette may contain an aerosol generating material that generates aerosols by operation (e.g., heating) of an aerosol generating device. Alternatively, the cigarette may not include an aerosol generating material and delivers an aerosol generated from another article (e.g., cartridge) installed in the aerosol generating device.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure can, however, be embodied in many different forms and should not be construed as being limited to the embodiments set forth herein.

Hereinafter, embodiments of the present disclosure will be described in detail with reference to the drawings.

Figure 2:
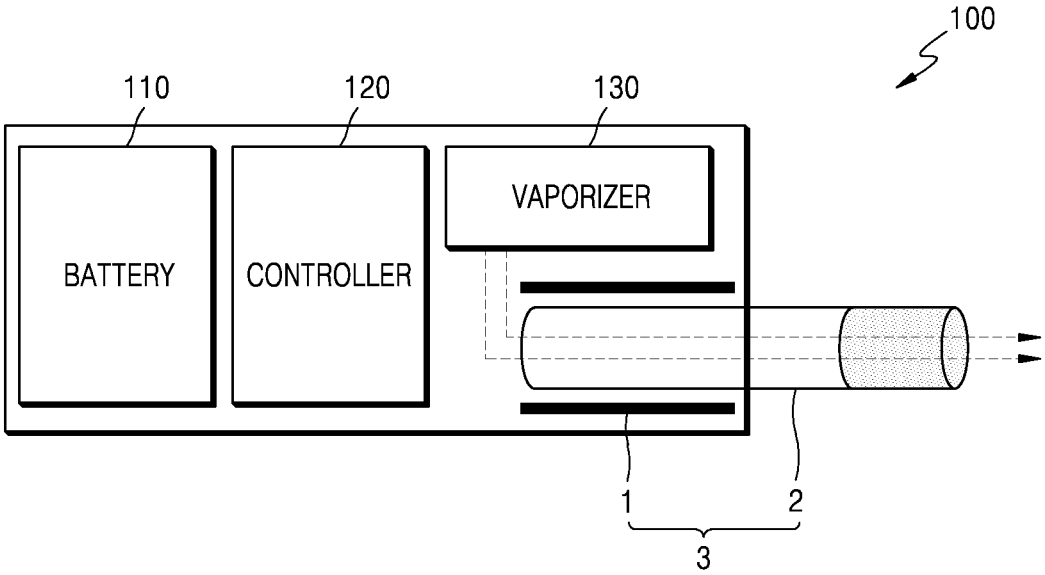

FIGS. 1 and 2 are views illustrating examples of an aerosol generating device including a heater assembly and an aerosol generating system.

Referring to FIGS. 1 and 2, an aerosol generating device 100 includes a battery 110, a heater assembly 1, and a vaporizer 130. Also, an aerosol generating article such as the cigarette 2 may be inserted into an inner space of the aerosol generating device 100.

FIGS. 1 and 2 illustrate only components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIG. 1.

Also, FIGS. 1 and 2 illustrate that the aerosol generating device 100 includes the heater assembly 1. However, according to necessity, the heater assembly 1 may be omitted.

FIG. 1 illustrates that the battery 110, the controller 120, the vaporizer 130, and the heater assembly 1 are arranged in series. Also, FIG. 2 illustrates that the vaporizer 130 and the heater assembly 1 are arranged in parallel. However, the internal structure of the aerosol generating device 100 is not limited to the structures illustrated in FIG. 1 or FIG. 2. In other words, according to the design of the aerosol generating device 100, the battery 110, the controller 120, the vaporizer 130, and the heater assembly 1 may be differently arranged.

When the cigarette 2 is inserted into the aerosol generating device 100, the aerosol generating device 100 may operate the vaporizer 130 to generate aerosol from the vaporizer 130. The aerosol generated by the vaporizer 130 is delivered to the user by passing through the cigarette 2. The vaporizer 130 will be described in more detail later.

The battery 110 may supply power to be used for the aerosol generating device 100 to operate. For example, the battery 110 may supply power to heat the heater assembly 1 or the vaporizer 130 and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110, the heater assembly 1, and the vaporizer 130, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater assembly 1 may be heated by the power supplied from the battery 110. For example, when the cigarette 2 is inserted into the aerosol generating device 100, the heater assembly 1 may be located outside the cigarette 2.

Thus, the heated heater assembly 1 may increase a temperature of an aerosol generating material in the cigarette 2.

The heater assembly 1 may include an electro-resistive heater assembly. For example, the heater assembly 1 may include an electrically conductive track, and the heater assembly 1 may be heated when currents flow through the electrically conductive track. However, the heater assembly 1 is not limited to the example described above, and a different heater assembly which may be heated to a desired temperature may be used. Here, the desired temperature may be pre-set in the aerosol generating device 100 or may be set as a temperature desired by a user.

As another example, the heater assembly 1 may include an induction heater assembly. In detail, the heater assembly 1 may include an electrically conductive coil for heating a cigarette in an induction heating method, and the cigarette may include a susceptor which may be heated by the induction heater assembly.

FIGS. 1 and 2 illustrate that the heater assembly 1 is positioned outside the cigarette 2, but the position of the cigarette 2 is not limited thereto. For example, the heater assembly 1 may include a tube-type heating element, a plate-type heating element, a needle-type heating element, or a rod-type heating element, and may heat the inside or the outside of the cigarette 2, according to the shape of the heating element.

Also, the aerosol generating device 100 may include a plurality of heater assemblys 1. Here, the plurality of heater assemblys 1 may be inserted into the cigarette 2 or may be arranged outside the cigarette 2. Also, some of the plurality of heater assemblys 1 may be inserted into the cigarette 2, and the others may be arranged outside the cigarette 2. In addition, the shape of the heater assembly 1 is not limited to the shapes illustrated in FIGS. 1 and 2 and may include various shapes.

The vaporizer 130 may generate an aerosol by heating a liquid composition and the generated aerosol may pass through the cigarette 2 to be delivered to a user. In other words, the aerosol generated via the vaporizer 130 may move along an air flow passage of the aerosol generating device 100 and the air flow passage may be configured such that the aerosol generated via the vaporizer 130 passes through the cigarette 2 to be delivered to the user.

For example, the vaporizer 130 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 130 or may be formed integrally with the vaporizer 130.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 130 may be referred to as a cartomizer or an atomizer, but it is not limited thereto.

The aerosol generating device 100 may further include general-purpose components in addition to the battery 110, the controller 120, and the heater assembly 1. For example, the aerosol generating device 100 may include a display capable of outputting visual information and/or a motor for outputting haptic information. Also, the aerosol generating device 100 may include at least one sensor (e.g., a puff detecting sensor, a temperature detecting sensor, a cigarette insertion detecting sensor, etc.). Also, the aerosol generating device 100 may be formed as a structure where, even when the cigarette 2 is inserted into the aerosol generating device 100, external air may be introduced or internal air may be discharged.

Although not illustrated in FIGS. 1 and 2, the aerosol generating device 100 and an additional cradle may form together a system. For example, the cradle may be used to charge the battery 110 of the aerosol generating device 100. Alternatively, the heater assembly 1 may be heated when the cradle and the aerosol generating device 100 are coupled to each other.

The cigarette 2 includes an aerosol generating material that generates an aerosol when heated.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 100, and the second portion may be exposed to the outside. Alternatively, only a portion of the first portion may be inserted into the aerosol generating device 100, or a portion of the first portion and a portion of the second portion may be inserted thereinto. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 100. For example, the opening and closing and/or a size of the air passage formed in the aerosol generating device 100 may be adjusted by the user. Accordingly, the amount of smoke and a smoking impression may be adjusted by the user. As another example, the external air may flow into the cigarette 2 through at least one hole formed in a surface of the cigarette 2.

Hereinafter, an example of the cigarette 2 will be described with reference to FIG. 3.

Figure 3:
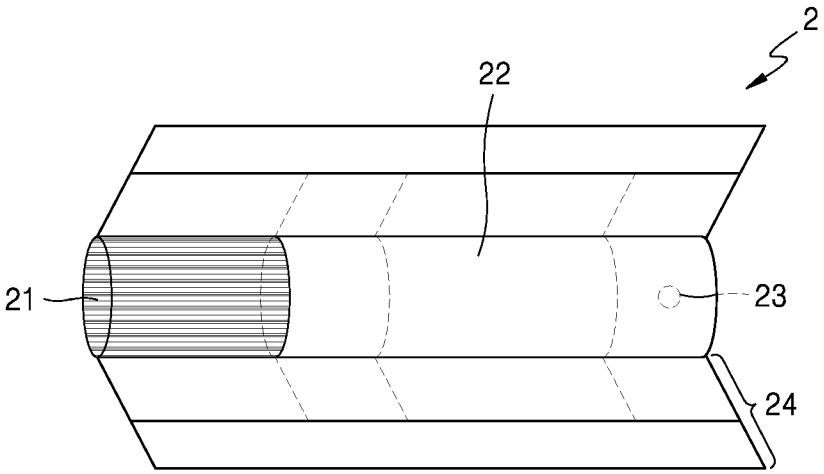
FIG. 3 is a drawing illustrating an example of a cigarette.

FIG. 3 is a drawing illustrating an example of a cigarette.

Referring to FIG. 3, the cigarette 2 may include a tobacco rod 21 and a filter rod 22 The first portion described above with reference to FIGS. 1 and 2 may include the tobacco rod 21, and the second portion may include the filter rod 22.

FIG. 3 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, according to necessity, the filter rod 22 may further include at least one segment configured to perform other functions.

The cigarette 20 may be packaged by at least one wrapper 24. The wrapper 24 may have at least one hole through which external air may be introduced or internal air may be discharged. For example, the cigarette 2 may be packaged by one wrapper 24. As another example, the cigarette 2 may be doubly packaged by at least two wrappers 24. For example, the tobacco rod 21 may be packaged by a first wrapper, and the filter rod 22 may be packaged by a second wrapper. Also, the tobacco rod 21 and the filter rod 22, which are respectively packaged by separate wrappers, may be coupled to each other, and the entire cigarette 2 may be packaged by a third wrapper. When each of the tobacco rod 21 and the filter rod 22 includes a plurality of segments, each segment may be packaged by a separate wrapper. Also, the entire cigarette 2 including the plurality of segments, which are respectively packaged by the separate wrappers and which are coupled to each other, may be re-packaged by another wrapper.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater assembly. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The filter rod 22 may be formed to generate flavors. For example, a flavoring liquid may be injected onto the filter rod 22, or an additional fiber coated with a flavoring liquid may be inserted into the filter rod 22.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

When the filter rod 22 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Although not illustrated in FIG. 3, the cigarette 2 according to an embodiment may further include a front-end filter. The front end plug may be located on one side of the tobacco rod 21 which is opposite to the filter rod 22. The front-end filter may prevent the tobacco rod 21 from being detached outwards and prevent a liquefied aerosol from flowing into the aerosol generating device 100 (FIGS. 1 and 2) from the tobacco rod 21, during smoking.

Figure 4:
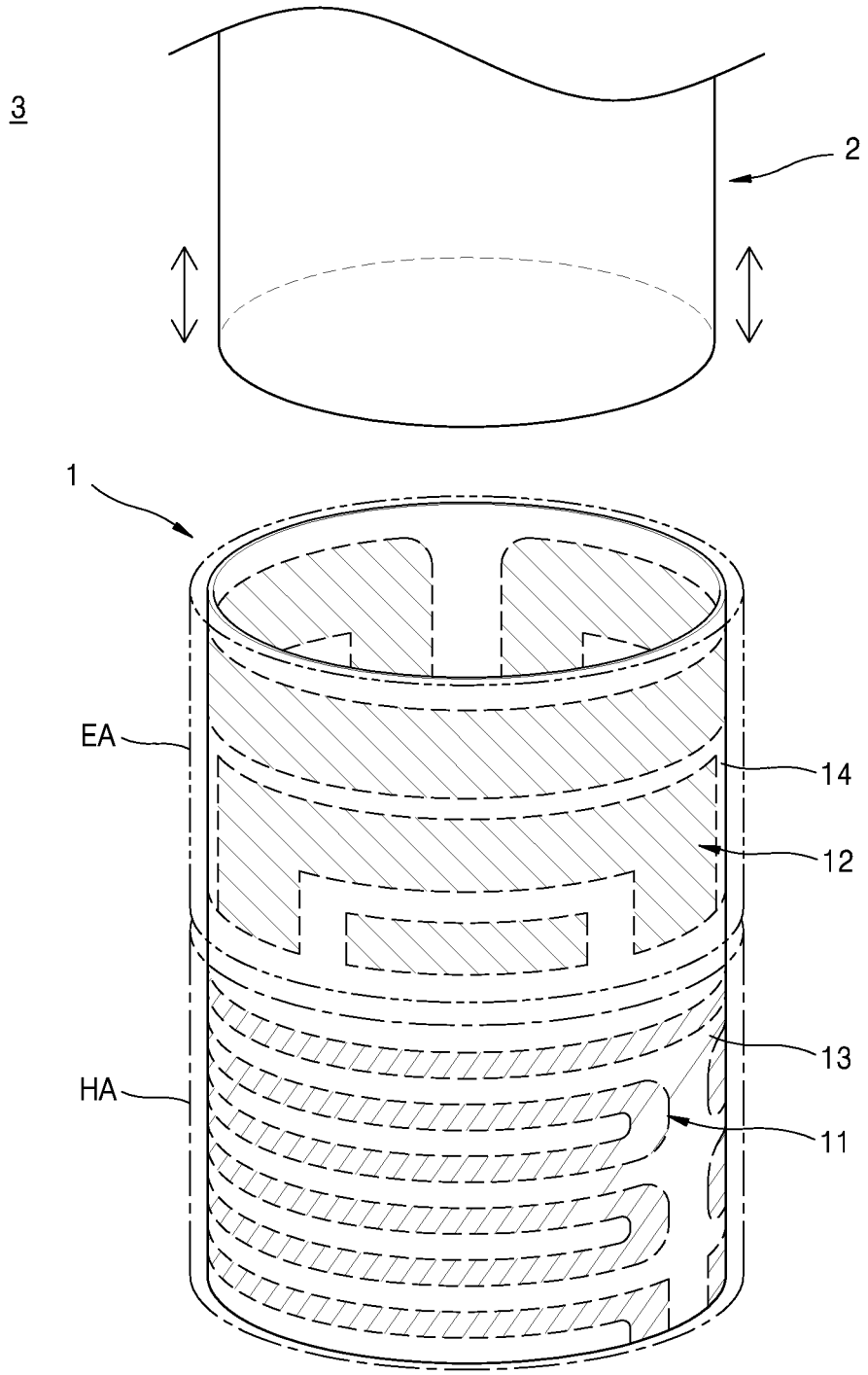
FIG. 4 is a schematic perspective view illustrating a heater assembly according to one embodiment.

FIG. 4 is a schematic perspective view illustrating a heater assembly according to one embodiment.

Referring to FIG. 4, the heater assembly 1 according to one embodiment includes a heating portion 11 for heating the aerosol generating article 2 when power is applied thereto, and an expansion portion 12 that is separated from the heating portion 11 and receives heat from the heating portion 11 to heat the aerosol generating article 2. Accordingly, the heater assembly 1 according to one embodiment may expand a region capable of heating the aerosol generating article 2 even when power is not applied to the expansion portion 12. Therefore, the heater assembly 1 according to one embodiment does not need to have a separate power supply device to expand a heating region for the aerosol generating article 2, and thus, operating costs for a heater may be reduced.

Hereinafter, the heating portion 11 and the expansion portion 12 will be described in detail with reference to the accompanying drawings.

The heating portion 11 heats the aerosol generating article 2 when power is applied thereto. The heating portion 11 may be connected to a power supply 10 (illustrated in FIG. 6) for applying power. The power supply 10 may be connected to each of a positive terminal 10*a* (illustrated in FIG. 6) and a negative terminal 10*b* (illustrated in FIG. 6) of the heating portion 11.

Figure 5:
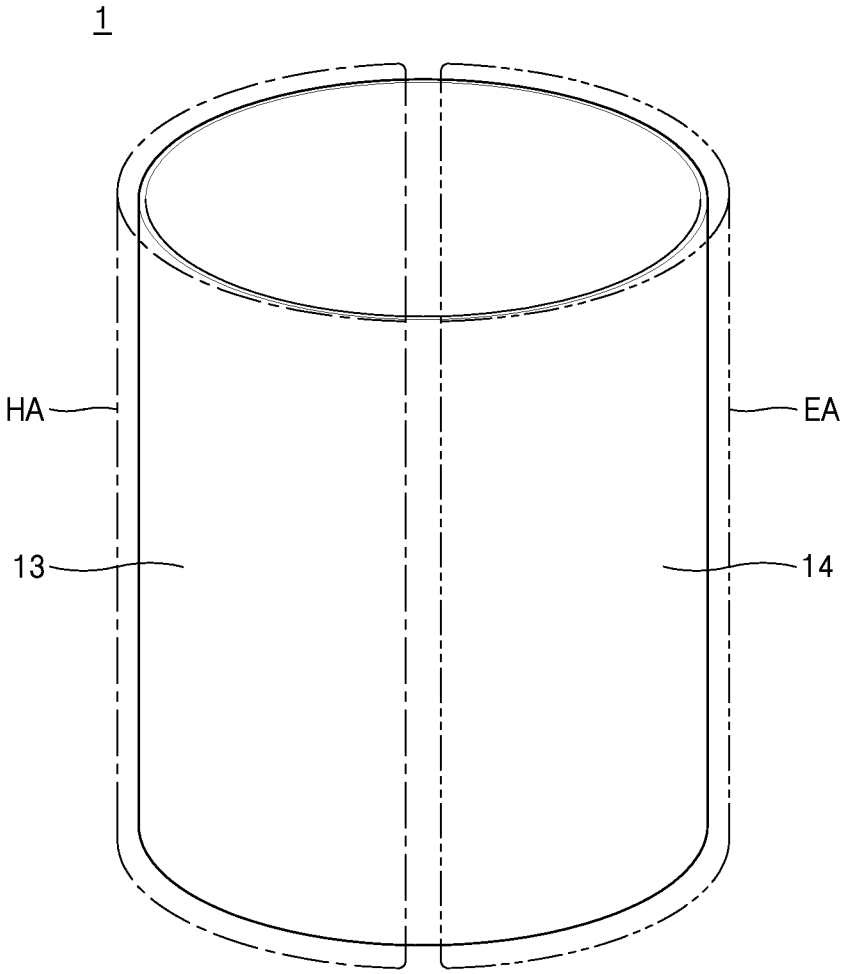
FIG. 5 is a schematic perspective view illustrating a heater assembly according to another embodiment.

Referring to FIGS. 4 and 5, the heating portion 11 may heat the aerosol generating article 2 to a first temperature. In this case, the heating portion 11 may form a heating region HA having the first temperature around the aerosol generating article 2. For example, the heating portion 11 may heat the aerosol generating article 2 in a range of 200° C. to 250° C. The heating portion 11 may heat at least part of the tobacco rod 21 and the filter rod 22. For example, the heating portion 11 may heat the tobacco rod 21.

The heating portion 11 may be formed of a material such as copper or steel use stainless (SUS). The heating portion 11 may include an electric resistance heater. For example, the heating portion 11 may include an electrically conductive track, and the heating portion 11 may be heated as a current flows through the electrically conductive track.

The expansion portion 12 may heat the aerosol generating article 2 to a second temperature lower than the first temperature. In this case, the expansion portion 12 may form an expansion region EA having the second temperature around the aerosol generating article 2.

The heater assembly 1 may further include a first support member 13 and a second support member 14. The first support member 13 supports the heating portion 11. At least part of the aerosol generating article 2 may be inserted into the first support member 13. For example, the tobacco rod 21 may be inserted into the first support member 13.

The second support member 14 supports the expansion portion 12. At least part of the aerosol generating article 2 may be inserted into the second support member 14. For example, the filter rod 22 may be inserted into the second support member 14.

FIG. 5 is a schematic perspective view illustrating a heater assembly according to another embodiment.

Referring to FIGS. 4 and 5, the expansion portion 12 heats the aerosol generating article 2 by receiving heat generated from the heating portion 11. The expansion portion 12 may receive heat from the heating portion 11 by at least one of conduction, convection, and radiation. The expansion portion 12 may be formed of a material such as copper or aluminum.

As aforementioned, the heating portion 11 may heat the aerosol generating article 2 to a first temperature, and the expansion portion 12 may heat the aerosol generating article 2 to a second temperature lower than the first temperature. Accordingly, the heater assembly 1 according to one embodiment may be embodied with a single heater that heats different areas of the aerosol generating article 2 to different temperatures without supplying power to the expansion portion 12. For example, the expansion portion 12 may heat the aerosol generating article 2 in a range of 60° C. to 70° C. The expansion portion 12 may heat at least part of the tobacco rod 21 and the filter rod 22. For example, the heater assembly 1 may be arranged such that the heating portion 11 heats the tobacco rod 21, and the expansion portion 12 heats the filter rod 22.

The expansion portion 12 may be embodied with a heat pipe having a hollow therein, but it is not limited thereto. For example, the expansion portion 12 may also be embodied with an electric resistance heater capable of receiving heat from the heating portion 11.

Referring to FIGS. 4 and 5, the expansion portion 12 may be separated from the heating portion 11. As illustrated in FIG. 4, the expansion portion 12 may be separated from the heating portion 11 in a lengthwise direction of the aerosol generating article 2 (i.e., in a direction in which the aerosol generating article 2 extends). In this case, the expansion region EA formed by the expansion portion 12 and the heating region HA formed by the heating portion 11 may be arranged in the lengthwise direction of the aerosol generating article 2. On the other hand, as shown in FIG. 5, the expansion portion 12 may be separated from the heating portion 11 in a circumferential direction of the aerosol generating article 2 inserted into the heater assembly 1. In this case, the expansion region EA formed by the expansion portion 12 and the heating region HA formed by the heating portion 11 may be arranged in the circumferential direction of the aerosol generating article 2.

Figure 6:
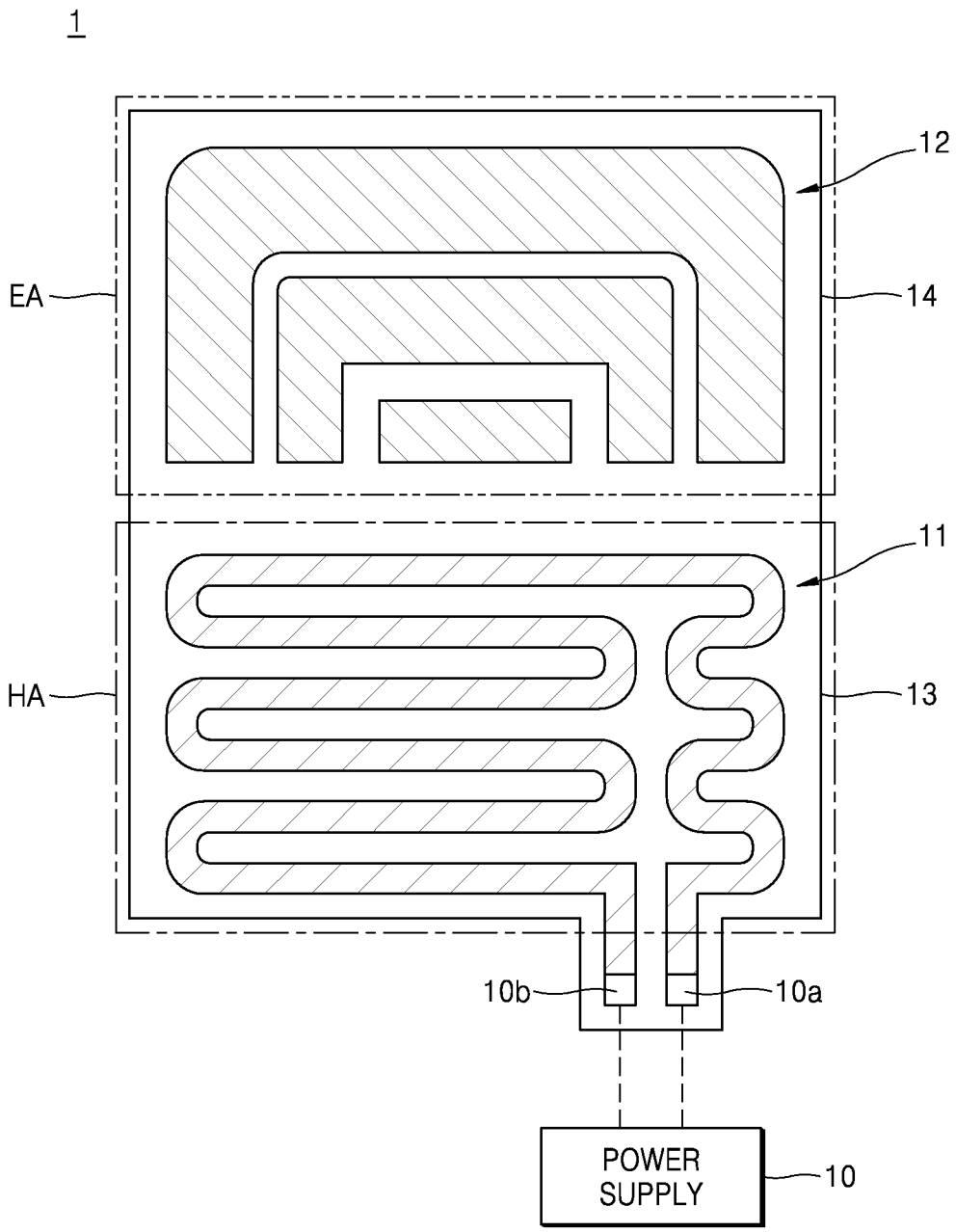
FIG. 6 is a schematic view illustrating a heating pattern and an expansion pattern in a heater assembly according to one embodiment.

FIG. 6 is a schematic view illustrating a heating pattern and an expansion pattern in a heater assembly according to one embodiment.

As shown in FIG. 6, the heating portion 11 and the expansion portion 12 may have different shapes. Also, the expansion portion 12 may have a plurality of separate patterns. For example, as shown in FIG. 7, the expansion portion 12 may have three patterns.

Figure 7:
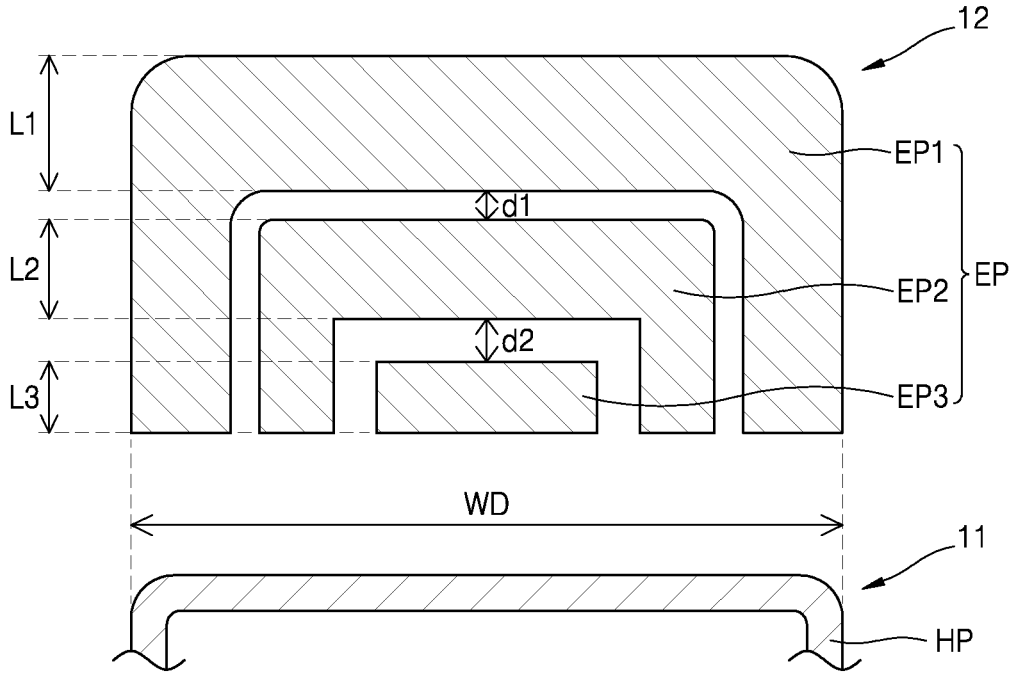
FIG. 7 is an enlarged schematic view of part of the heater assembly according to the embodiment of FIG. 6.

FIG. 7 is an enlarged schematic view of part of the heater assembly according to one embodiment of FIG. 6. The hatching added in FIGS. 4, 6, and 7 is not used to represent a cross-sectional view and is used for the purpose of distinguishing a configuration.

Referring to FIG. 7, the expansion portion 12 and the heating portion 11 may have the same width WD in a circumferential direction of the aerosol generating article 2. Accordingly, in the heater assembly 1 according to one embodiment, the heat transferred to the expansion portion 12 from the heating portion 11 may be uniform along the circumferential direction of the aerosol generating article 2.

As shown in FIGS. 6 and 7, the expansion portion 12 may have a symmetrical shape with respect to an axis extending in the lengthwise of the aerosol generating article 2. Accordingly, heat transferred from the heating portion 11 may be evenly spread over the expansion region EA.

Hereinafter, embodiments of an expansion pattern EP of the expansion portion 12 and a heating pattern HP of the heating portion 11 will be described with reference to the accompanying drawings. The expansion pattern EP and the heating pattern HP illustrated in FIGS. 6 and 7 are an example, and embodiments are not limited thereto.

Referring to FIG. 7, the expansion portion 12 may include a plurality of expansion patterns EP that receive heat from the heating portion 11. Hereinafter, description will be made on the basis of the expansion portion 12 having three expansion patterns EP1, EP2, and EP3, and it will be apparent to those skilled in the art to which the present disclosure pertains to derive an embodiment relating to the expansion portion 12 including two or four or more expansion patterns EP from the three expansion patterns.

Referring to FIG. 7, the plurality of expansion patterns EP may be formed to have wider areas as a distance from the heating portion 11 increases. In the embodiment illustrated in FIG. 7, among the three expansion patterns EP1, EP2, and EP3, a first area L1 of the first expansion pattern EP1, which is the farthest from the heating portion 11, may be formed to be the largest, and a third area L3 of the third expansion pattern EP3, which is the closest to the heating portion 11 may be formed to be the smallest. In addition, a second area L2 of the second expansion pattern EP2 between the first expansion pattern EP1 and the third expansion pattern EP3 may be formed to be smaller than the first area L1 and larger than the third area L3. Accordingly, the expansion portion 12 may uniformly heat the aerosol generating article 2 corresponding to the expansion region EA by increasing heat receiving area of the expansion pattern as a distance from the heating portion 11 increases.

Referring to FIG. 7, an interval between the expansion patterns may become narrower as a distance from the heating portion 11 increases. In the embodiment illustrated in FIG. 7, a first interval d1 between the first expansion pattern EP1 and the second expansion pattern EP2 may be formed to be smaller than a second interval d2 between the second expansion pattern EP2 and the third expansion pattern EP3. Accordingly, the expansion portion 12 may uniformly heat the entire aerosol generating article 2 corresponding to the expansion region EA by increasing heat concentration in the interval between the expansion patterns as a distance from the heating portion 11 increases.

Although FIGS. 6 and 7 illustrate three separate expansion patterns EP1, EP2, and EP3, the number of the expansion pattern is not limited thereto. For example, the expansion portion 12 may include a single expansion pattern.

Although not illustrated, the heating portion 11 may also include a plurality of heating patterns HP which are separated from each other and transfer heat to the expansion portion 12. The area of each heating pattern may increase as a distance from the power supply 10 increases. Also, an interval between two heating patterns may decrease as a distance from the power supply 10 increases. Alternatively, the heating portion 11 may include a single heating pattern HP as illustrated in FIG. 6.

Figure 8:
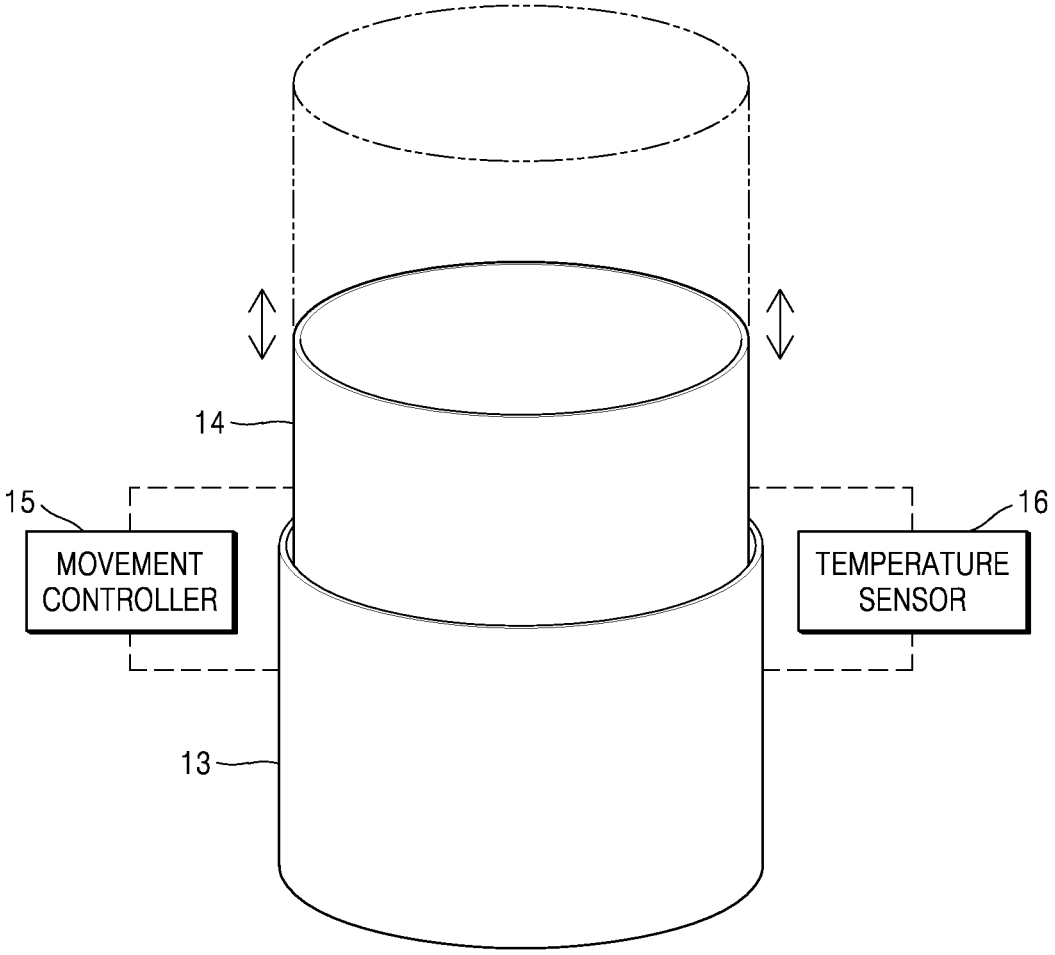
FIG. 8 is a schematic perspective view illustrating an embodiment in which a separation distance between a heating portion and an expansion portion is adjusted in a heater assembly according to one embodiment.

FIG. 8 is a schematic perspective view illustrating an embodiment in which a separation distance between a heating portion and an expansion portion is adjusted in a heater assembly according to one embodiment.

Referring to FIGS. 4 to 6, the heater assembly 1 may include a first support member 13 and a second support member 14.

The first support member 13 supports the heating portion 11. At least part of the aerosol generating article 2 may be inserted into the first support member 13. For example, the tobacco rod 21 may be inserted into the first support member 13. The first support member 13 may be formed to have a hollow cylindrical shape as a whole. The first support member 13 may be formed of a conductive material. For example, the first support member 13 may be formed of a polyimide (PI) film.

The second support member 14 supports the expansion portion 12. At least part of the aerosol generating article 2 may be inserted into the second support member 14. For example, the filter rod 22 may be inserted into the second support member 14. The second support member 14 may be formed to have a hollow cylindrical shape as a whole. The second support member 14 may be formed of a conductive material. For example, the second support member 14 may be formed of a PI film.

The second support member 14 may be coupled to the first support member 13. When the expansion portion 12 is separated from the heating portion 11 in the lengthwise direction of the aerosol generating article 2 as illustrated in FIG. 4, the second support member 14 may be coupled to the first support member 13 in the lengthwise direction of the aerosol generating article 2. When the expansion portion 12 and the heating portion 11 are separated from each other in a circumferential direction of the aerosol generating article 2 inserted into the heater assembly 1 as illustrated in FIG. 5, the second support member 14 may be coupled to the first support member 13 in the circumferential direction of the aerosol generating article 2. The second support member 14 may be integrally formed with the first support member 13.

Referring to FIG. 8, the second support member 14 may be movable with respect to the first support member 13 such that a separation distance between the expansion portion 12 and the heating portion 11 is adjusted. Accordingly, the expansion portion 12 and the heating portion 11 may overlap each other or may be separated from each other in the lengthwise direction of the aerosol generating article 2. Therefore, the heater assembly 1 according to one embodiment may adjust heat transfer amount between the expansion portion 12 and the heating portion 11 according to various usage environments.

In the present embodiment, the second support member 14 is movable with respect to the first support member 13, but the embodiments are not limited thereto. For example, the first support member 13 may be movable with respect to the second support member 14, or both the first support member 13 and the second support member 14 may be movable.

As shown in FIG. 8, the second support member 14 may be inserted into the first support member 13 and may be movable with respect to the first support member 13. In this case, the second support member 14 may have a smaller diameter than the first support member 13. However, embodiments are not limited thereto. For example, the first support member 13 may be inserted into the second support member 14.

According to an embodiment, the heater assembly 1 may include a corrugated portion (not illustrated) disposed between the expansion portion 12 and the heating portion 11. The corrugated portion may be connected to the second support member 14 and the first support member 13. As a separation distance between the expansion portion 12 and the heating portion 11 increases, a total length of the corrugated portion may increase in a lengthwise direction of the aerosol generating article 2. As the separation distance between the expansion portion 12 and the heating portion 11 is reduced, the total length of the corrugated portion may be reduced in the lengthwise direction of the aerosol generating article 2. In this case, at least parts of the corrugated portion may overlap each other. The corrugated portion, the second support member 14, and the first support member 13 may be integrally formed.

Referring to FIG. 8, the heater assembly 1 according to one embodiment may further include a movement controller 15.

The movement controller 15 controls movement of at least one of the second support member 14 and the first support member 13. The movement controller 15 may be connected to at least one of the second support member 14 and the first support member 13. The movement controller 15 may also control movement of at least one of the second support member 14 and the first support member 13 by using various methods such as a ball screw method using a motor and a ball screw, or a gear method using a motor, a rack gear, a pinion gear, and a screw gear. The movement controller 15 may also be embodied with a slide switch. Hereinafter, description will be made on the basis of an embodiment in which the movement controller 15 controls movement of the second support member 14.

Referring to FIG. 8, the heater assembly 1 according to one embodiment may include a temperature sensor 16.

The temperature sensor 16 detects a temperature of at least one of the expansion portion 12 and the heating portion 11. The temperature sensor 16 may be connected to at least one of the expansion portion 12 and the heating portion 11. The temperature sensor 16 may transfer information about the detected temperature to the movement controller 15. The temperature sensor 16 may detect a temperature of the expansion portion 12 and/or the heating portion 11.

In this case, the movement controller 15 may control movement of at least one of the second support member 14 and the first support member 13 according to the detection result from the temperature sensor 16. For the convenience of description, it will be assumed that the temperature sensor 16 detects the temperature of the expansion portion 12.

First, the temperature sensor 16 may detect that the temperature of the expansion portion 12 is lower than or equal to a preset temperature value. The preset temperature value may be a value preset by a user. The temperature sensor 16 may transfer information about the temperature of the expansion portion 12 to the movement controller 15. The movement controller 15 may move the second support member 14 toward the first support member 13 such that at least parts of the expansion portion 12 and the heating portion 11 may overlap each other. Accordingly, the amount of heat that the expansion portion 12 receives from the heating portion 11 may be increased by reducing a separation distance between the expansion portion 12 and the heating portion 11.

Next, the temperature sensor 16 may detect that the temperature of the expansion portion 12 is greater than or equal to the preset temperature value. The temperature sensor 16 may transfer information about the temperature of the expansion portion 12 to the movement controller 15. The movement controller 15 may move the second support member 14 away from the first support member 13 such that the expansion portion 12 and the heating portion 11 may be separated from each other. Accordingly, the amount of heat that the expansion portion 12 receives from the heating portion 11 may be reduced by increasing the separation distance between the expansion portion 12 and the heating portion 11.

At least one of the components, elements, modules or units (collectively "components" in this paragraph) represented by a block in the drawings, such as the controller 120 or the movement controller 15, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol generating system comprising:

an aerosol generating article including an aerosol generating material that generates an aerosol when heated;

a battery;

a heating portion configured to heat the aerosol generating article by using power supplied by the battery;

an expansion portion separated from the heating portion and configured to receive heat from the heating portion and heat the aerosol generating article;

a first support member configured to support the heating portion; and a second support member configured to support the expansion portion, wherein the heating portion and the expansion portion are configured to heat an outside of the aerosol generating article.

2. The aerosol generating system of claim 1, wherein the heating portion heats the aerosol generating article to a first temperature, and the expansion portion heats the aerosol generating article to a second temperature lower than the first temperature.

3. A heater assembly for an aerosol generating device, comprising:

a heating portion configured to heat an aerosol generating article by using electrical power applied to the heating portion;

an expansion portion separated from the heating portion and configured to receive heat from the heating portion and heat the aerosol generating article a first support member configured to support the heating portion; and a second support member configured to support the expansion portion, wherein the heating portion and the expansion portion are configured to heat an outside of the aerosol generating article.

4. The heater assembly of claim 3, wherein the heating portion heats the aerosol generating article to a first temperature, and the expansion portion heats the aerosol generating article to a second temperature lower than the first temperature.

5. The heater assembly of claim 3, wherein the expansion portion receives the heat from the heating portion by at least one of conduction, convection, and radiation.

6. The heater assembly of claim 3, wherein the expansion portion and the heating portion have a same length in a circumferential direction of the aerosol generating article.

7. The heater assembly of claim 3, wherein the expansion portion has a shape symmetrical with respect to an axis extending in a lengthwise direction of the aerosol generating article.

8. The heater assembly of claim 3, wherein the expansion portion includes a plurality of expansion patterns that receive the heat from the heating portion, and a first expansion pattern has a larger area than a second expansion pattern that is closer to the heating portion than the first expansion pattern.

9. The heater assembly of claim 3, wherein the expansion portion includes three or more expansion patterns that receive the heat from the heating portion, and the expansion patterns are arranged such that an interval between two expansion patterns becomes smaller as a distance between the interval from the heating portion increases.

10. The heater assembly of claim 3, wherein the expansion portion is separated from the heating portion in a lengthwise direction of the aerosol generating article.

11. The heater assembly of claim 3, wherein the expansion portion and the heating portion are separated from each other in a circumferential direction of the aerosol generating article.

12. The heater assembly of claim 3, wherein the second support member is movable with respect to the first support member to adjust a separation distance between the expansion portion and the heating portion.

13. The heater assembly of claim 12, wherein one of the first support member and the second support member is insertable into the other.

14. The heater assembly of claim 12, further comprising a movement controller configured to control movement of the second support member.

15. The heater assembly of claim 14, further comprising a temperature sensor configured to detect a temperature of at least one of the expansion portion and the heating portion, wherein the movement controller controls the movement of the second support member based on the detected temperature.

* * * * *